US008035607B2

(12) United States Patent
Otome

(10) Patent No.: US 8,035,607 B2
(45) Date of Patent: Oct. 11, 2011

(54) IMAGE DISPLAY APPARATUS AND ELECTRONIC APPARATUS

(75) Inventor: Takashi Otome, Matsumoto (JP)

(73) Assignee: Sony Corporation, Tokyo (JP)

( * ) Notice: Subject to any disclaimer, the term of this patent is extended or adjusted under 35 U.S.C. 154(b) by 1007 days.

(21) Appl. No.: 11/979,712

(22) Filed: Nov. 7, 2007

(65) Prior Publication Data

US 2008/0204396 A1 Aug. 28, 2008

(30) Foreign Application Priority Data

Feb. 28, 2007 (JP) ..... 2007-048597

(51) Int. Cl.
*G09G 3/36* (2006.01)

(52) U.S. Cl. ..... 345/102

(58) Field of Classification Search ..... 345/102, 345/82, 690

See application file for complete search history.

(56) References Cited

U.S. PATENT DOCUMENTS

| | | | | |
|---|---|---|---|---|
| 4,864,290 | A * | 9/1989 | Waters | 345/89 |
| 5,065,357 | A * | 11/1991 | Shiraishi et al. | 345/102 |
| 5,808,597 | A * | 9/1998 | Onitsuka et al. | 345/102 |
| 5,929,831 | A * | 7/1999 | Aratani et al. | 345/97 |
| 7,362,295 | B2 | 4/2008 | Park et al. | |
| 7,388,998 | B2 * | 6/2008 | Han et al. | 382/274 |
| 7,580,024 | B2 | 8/2009 | Kamimura | |
| 2005/0140631 | A1 | 6/2005 | Oh et al. | |
| 2008/0198107 | A1 | 8/2008 | Park et al. | |

FOREIGN PATENT DOCUMENTS

| | | |
|---|---|---|
| JP | A-9-37010 | 2/1997 |
| JP | A-2004-054250 | 2/2004 |
| JP | A-2004-246099 | 9/2004 |
| JP | A-2004-272270 | 9/2004 |
| JP | A-10-2005-0068172 | 7/2005 |
| JP | A-2005-241817 | 9/2005 |
| JP | A-2007-36728 | 2/2007 |

* cited by examiner

*Primary Examiner* — Quan-Zhen Wang
*Assistant Examiner* — Sepideh Ghafari
(74) *Attorney, Agent, or Firm* — K&L Gates LLP

(57) ABSTRACT

The invention provides an image display apparatus that includes: a frame memory into which inputted image data is stored; a statistical computation section that performs statistical computation on a gradation value of each pixel on the basis of the image data for each frame image; a correction section that corrects the image data stored in the frame memory on a frame-by-frame basis by means of a statistical computation result calculated at the statistical computation section; an image display section that performs image display by means of the image data corrected at the correction section; a light source control section that calculates a control amount applied to the amount of light emitted from a light source on the basis of the corrected image data and then controls the amount of light emitted from the light source in accordance with the control amount; and a still picture judgment section that makes a judgment as to whether the frame image constitutes a still picture or not. In such a configuration of the image display apparatus according to an aspect of the invention, the statistical computation section suspends the statistical computation till the frame image is updated if the still picture judgment section judges that the frame image constitutes a still picture.

6 Claims, 9 Drawing Sheets

IMAGE DISPLAY APPARATUS AND ELECTRONIC APPARATUS

BACKGROUND

1. Technical Field

The present invention relates to an image display apparatus that adjusts the brightness of image data and the amount of light emitted from a light source in accordance with inputted image data so as to perform an enhanced image display. The present invention further relates to an electronic apparatus that is provided with such an improved image display apparatus.

2. Related Art

When there is no power supplied from an external source, an image display apparatus known in the related art display images while controlling the amount of light that passes through a liquid crystal panel when a light source (e.g., cold-cathode tube) converts power that is supplied from a battery into light. An example of such a known image display apparatus is a notebook-sized personal computer that has a type of display device such as a liquid crystal panel or the like, which is not a self-luminous device. Generally speaking, the percentage of power consumed by a light source of an apparatus to total power consumed by entire components of the apparatus is large. It is a popular technique in the related art to decrease the amount of light that is emitted from a light source in order to reduce power consumption of an apparatus when the apparatus is driven by power supplied from a battery (hereafter, this well-known light-amount reduction technique is referred to as "dimming" where the context allows). As the amount of light emitted from a light source is decreased, so does the brightness of an image on the entire screen, which causes degradation in visibility. Therefore, a technical solution that achieves reduction in power consumption by decreasing the amount of light emitted from a light source without sacrificing visibility is desired in the art.

As a known example of technical solutions to cope with such a problem, JP-A-2004-246099 and JP-A-2004-54250 teach a technique for reducing power consumption without losing apparent luminosity, which is achieved by converting data that is originally represented in RGB into brightness color difference data so as to perform brightness enhancement and backlight amount reduction (dimming) processing.

Although it is possible to reduce power consumption by decreasing the amount of light that is emitted from a backlight to some degree as described above, further reduction in power consumption is desired in the art.

SUMMARY

An advantage of some aspects of the invention is to provide an image display apparatus that achieves power reduction to a greater level that has not been achieved so far. Advantageously, the invention further provides an electronic apparatus that is provided with such an improved image display apparatus.

In order to address the above-identified problem without any limitation thereto, the invention provides, as a first aspect thereof, an image display apparatus including: a frame memory into which inputted image data is stored; a statistical computation section that performs statistical computation on a gradation value of each pixel on the basis of the image data for each frame image; a correction section that corrects the image data stored in the frame memory on a frame-by-frame basis by means of a statistical computation result calculated at the statistical computation section; an image display section that performs image display by means of the image data corrected at the correction section; a light source control section that calculates a control amount applied to the amount of light emitted from a light source on the basis of the corrected image data and then controls the amount of light emitted from the light source in accordance with the control amount; and a still picture judgment section that makes a judgment as to whether the frame image constitutes a still picture or not, wherein the statistical computation section suspends the statistical computation till the frame image is updated if the still picture judgment section judges that the frame image constitutes a still picture.

With such a configuration, it is possible to reduce power consumption of the apparatus as a whole by suspending the operation of the statistical computation section so as to save power that is otherwise consumed by the statistical computation section. In the configuration of the image display apparatus according to the first aspect of the invention described above, it is preferable that the statistical computation section performs, if the still picture judgment section judges that the frame image constitutes a still picture, statistical computation on the frame image that constitutes the still picture and then, after storing the statistical computation result into a memory area, suspends the statistical computation; and the correction section performs correction on the image data by means of the statistical computation result stored in the memory area during a period in which the statistical computation of the statistical computation section is suspended.

With such a configuration, although no statistical computation result is obtained during a time period in which the statistical computation operation of the statistical computation section is suspended, since a statistical computation result has been stored in the memory area in advance, it is still possible for the correction section to perform the correction processing on the image data in a reliable manner by means of the pre-stored statistical computation result. In addition, considering that the image data of the still-picture frame image does not change during the above-mentioned time period in which the statistical computation operation of the statistical computation section is suspended, the invention can be implemented without causing any problem even when the correction processing of the image data is performed by means of the above-mentioned statistical computation result that has been stored in the memory area in advance.

In the configuration of the image display apparatus according to the first aspect of the invention described above, it is preferable that the correction section performs correction on the image data stored in the frame memory by means of the statistical computation result calculated at the statistical computation section on the basis of the image data, and thereafter, stores the corrected image data into the frame memory; the image display section performs image display by means of the corrected image data that is stored in the frame memory; and the correction section suspends the correction till the frame image is updated if the still picture judgment section judges that the frame image constitutes a still picture. With such a configuration, it is possible to further reduce power consumption of the apparatus as a whole by suspending not only the operation of the statistical computation section so as to save power that is otherwise consumed by the statistical computation section but also the operation of the correction section so as to save power that is otherwise consumed by the correction section.

In the configuration of the image display apparatus described above, it is preferable that the statistical computation section performs the statistical computation on the inputted image data and stores the image data into the frame memory. With such a configuration, it is possible for the statistical computation section to start the statistical computation operation at an earlier timing because the statistical computation section performs the statistical computation operation by means of the image data that has not yet been written into the frame memory (i.e., pre-written data), which means that the statistical computation section can obtain the statistical computation operation at an earlier timing.

It is preferable that the image display apparatus according to the first aspect of the invention described above should further include a filtering section that performs low-pass filter processing on at least one of the corrected image data and the control amount applied to the amount of light emitted from the light source, the filtering section suspending the filter processing till the frame image is updated if the still picture judgment section judges that the frame image constitutes a still picture. With such a configuration, it is possible to further reduce power consumption of the apparatus as a whole by further suspending the operation of the filtering section so as to save power that is otherwise consumed by the filtering section.

In the configuration of the image display apparatus according to the first aspect of the invention described above, it is preferable that an image supplying apparatus that supplies the image data attaches, prior to the supplying thereof, still picture information indicating that the frame image constitutes a still picture to the image data of the frame image that corresponds to the still picture; and the still picture judgment section makes a judgment as to whether the frame image constitutes a still picture or not on the basis of the still picture information attached to the image data. With such a configuration, since the still picture information indicating whether the frame image constitutes a still picture or not is attached to the image data of the frame image at the image supplying apparatus that supplies the image data, it is possible for the still picture judgment section to judge whether the frame image constitutes a still picture or not in an easy manner. In order to address the above-identified problem without any limitation thereto, the invention provides, as a second aspect thereof, an electronic apparatus that is provided with the image display apparatus having the configuration described above. Therefore, the electronic apparatus that is provided with the image display apparatus according to the invention can offer reduced power consumption.

BRIEF DESCRIPTION OF THE DRAWINGS

The invention will be described with reference to the accompanying drawings, wherein like numbers reference like elements.

FIG. 3A is a diagram that illustrates the functional configuration of a histogram generation unit that is illustrated in FIG. 2, whereas

DESCRIPTION OF EXEMPLARY EMBODIMENTS

Figure 1:
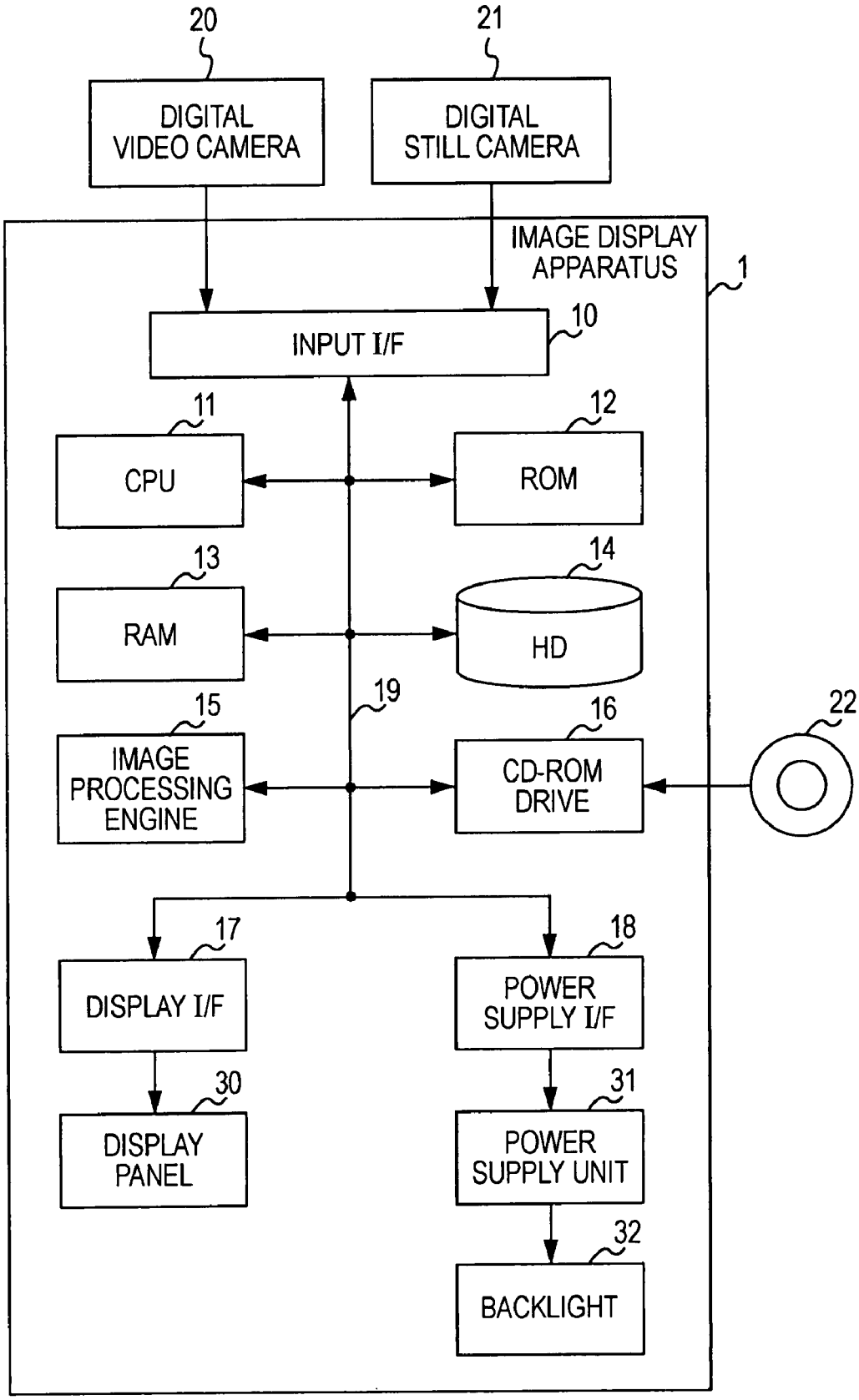
FIG. 1 is a diagram that schematically illustrates an example of the configuration of an image display apparatus according to a first embodiment of the invention.

With reference to the accompanying drawings, exemplary embodiments of the present invention are explained below. In the following description, a first exemplary embodiment of the invention is explained. FIG. 1 is a diagram that schematically illustrates an example of the hardware configuration of an image display apparatus 1 to which the invention is applied. As illustrated in FIG. 1, the image display apparatus 1 is provided with an input interface (hereafter abbreviated as "input I/F") 10, a central processing unit (hereafter abbreviated as "CPU") 11, a ROM 12, a RAM 13, a hard disk (hereafter abbreviated as "HD") 14, an image processing engine 15, a CD-ROM drive 16, a display interface (hereafter abbreviated as "display I/F") 17, and a power supply interface (hereafter abbreviated as "power supply I/F") 18. These components are interconnected with one another via a bus 19. The display I/F 17 is connected to a display panel 30. The power supply I/F 18 is connected to a power supply unit 31. As non-limiting specific examples of the image display apparatus 1, a notebook-sized personal computer, a projector, a television set, a mobile phone, or the like that can display images by means of the display panel 30 is conceivable. As an example of modified configurations, the image processing engine 15 may be provided not on a main bus as explicitly illustrated herein but somewhere on a dedicated bus between image input (e.g., CPU I/O, DMA from a communication/external device, or the like) and image output.

The input I/F 10 is connected to a digital video camera 20 and a digital still camera 21, which are a non-limiting example of external devices that supply video/image signal inputs to the image display apparatus 1. In addition to the above camera signals, video/image signals distributed via network equipment, and/or video/image content distributed over the air as radio signals can also be inputted into the image display apparatus 1 via the input I/F 10. The CPU 11 is responsible for controlling various kinds of processing performed in the image display apparatus 1. In particular, when an image/video signal is inputted into the image display apparatus 10 via the input I/F 10, or when an image/video signal is read for reproduction/replay that is stored in the HD 14 or a compact disc (hereafter abbreviated as "CD") 22, the CPU 11 transfers the image/video signal to the image processing engine 15 so that image display is performed.

The power supply unit 31 supplies power that is charged in a built-in/attached battery inside the power supply unit 31 or power that is supplied from the outside of the image display apparatus 1 to inner components of the image display apparatus 1, including but not limited to a backlight 32. The backlight 32 is a light source such as a cold-cathode tube, an LED (Light Emitting Diode), or the like that converts the power supplied from the power supply unit 31 into light. Light that has been emitted from the backlight 32 is spread by a light-diffusing sheet or the like that is interposed between the backlight 32 and the display panel 30, and then irradiated onto the display panel 30 as almost uniformly spread light.

The display panel 30 is a light-transmissive liquid crystal panel that displays a color image. Specifically, the display panel 30 performs display while controlling, for each pixel, a light transmission factor, which is the ratio of the amount of light received from the backlight 32 to the amount of light that transmits through the display panel 30. The display panel 340 performs such light transmissivity control by modulating light in accordance with a driving signal that corresponds to image data inputted therein through the display I/F 17. Since the display panel 30 performs display while controlling the light transmission factor, the brightness of an image changes in proportion to the amount of light that is supplied from the backlight 32.

Figure 2:
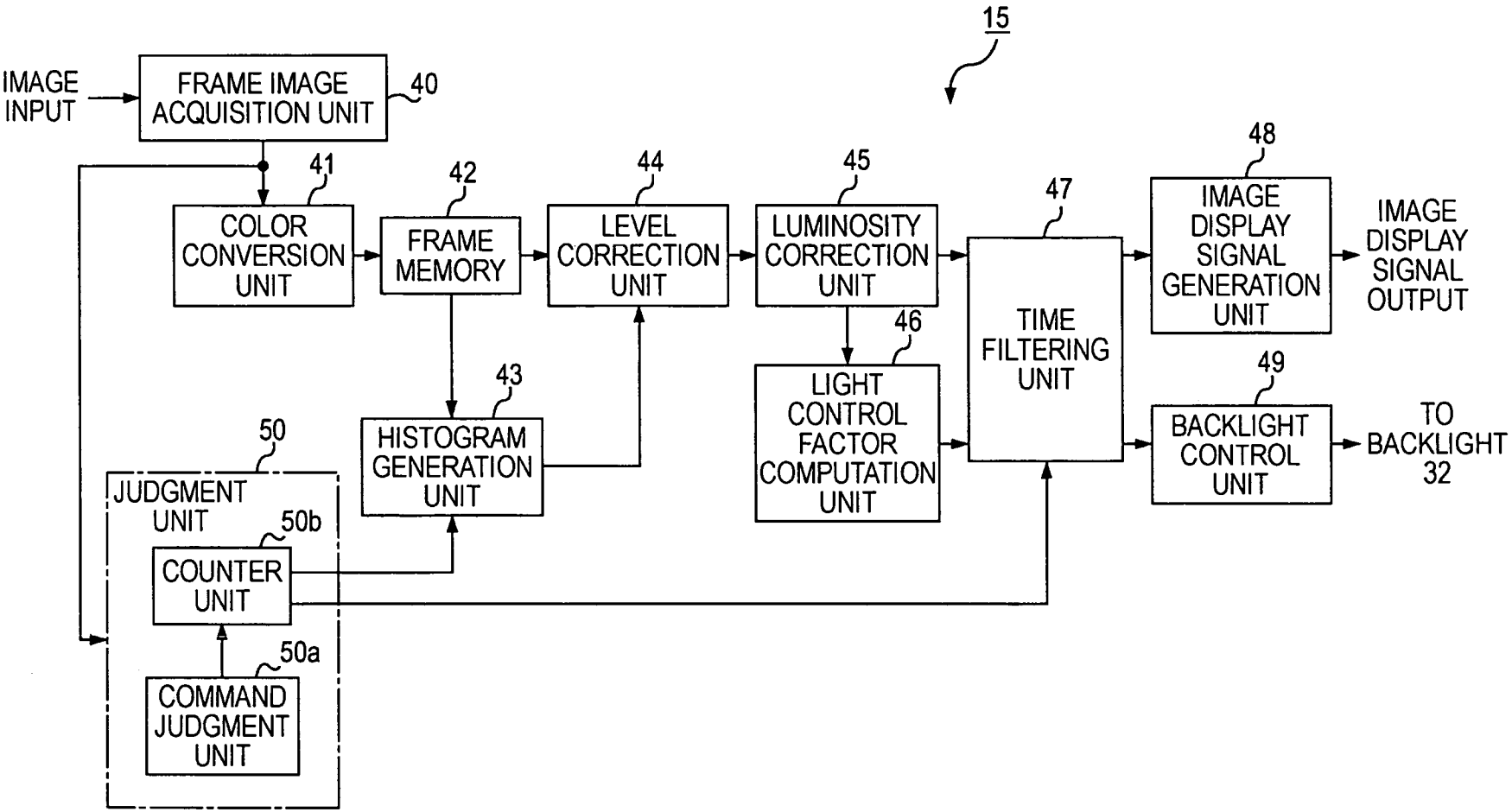
FIG. 2 is a block diagram that schematically illustrates an example of the configuration of an image processing engine according to the first embodiment of the invention.

FIG. 2 is a block diagram that schematically illustrates an example of the internal configuration of the image processing engine 15. As illustrated in FIG. 2, the image processing engine 15 is provided with, as its constituent elements, a frame image acquisition unit 40, a color conversion unit 41, a frame memory 42, a histogram generation unit 43, a level compensation/correction unit 44, a luminosity compensation/correction unit 45, a light control factor (i.e., percentage) computation unit 46, a time filtering unit 47, an image display signal generation unit 48, a backlight control unit 49, and a judgment unit 50.

The frame image acquisition unit 40 sequentially acquires frame image data, which is data of an image for each frame, from an image signal that has been inputted into the image display apparatus 1 via the input I/F 10. Herein, it is assumed that the inputted image signals are data representing a plurality of still-picture images that are consecutive in time series (hereafter simply referred to as "frame image"). In some cases, the inputted image signals have been subjected to compression. In other cases, they might be interlaced. If the imputed image signals are compressed or interlaced, the frame image acquisition unit 40 decompresses the compressed data or converts the interlace format data into non-interlace one. By this means, the frame image acquisition unit 40 acquires image data of each frame image from the inputted image signal in a data format that can be handled by the image processing engine 15. For example, the frame image acquisition unit 40 acquires, as image data, YCbCr data that is represented mainly by Y (brightness), Cb (U) (color difference that is determined with respect to a blue-yellow axis), and Cr (V) (color difference that is determined with respect to a red-green axis) on a large number of pixels that are arrayed in a matrix pattern such as horizontal 640×vertical 480. It should be noted that the number of pixels that represents a frame image and the number of gradations for each pixel may be set arbitrarily. In addition, various kinds of image data formats such as RGB data and the like are acceptable.

If an image signal that is inputted by an image signal supplying apparatus such as the digital video camera 20, the digital still camera 21, or the like into the image display apparatus 1 is a still-picture image, that is, a type of picture whose frame images do not change for more than one frame-update cyclic periods, the image signal supplying apparatus may transmit such a still-picture image signal with some additional information added thereto. Specifically, in such a case, the image signal supplying apparatus may add information on a picture mode that indicates that the image signal is still-picture data at the heading/headmost portion of the transmitted still-picture image signal; and in addition, the image signal supplying apparatus further adds information on the data amount, that is, data amount for one frame. If the transmitted image signal is accompanied by such additional information, the frame image acquisition unit 40 outputs the image mode and the data amount, in addition to the acquired frame image, to the judgment unit 50. After transmitting the still-picture image data, the image supplying apparatus does not transmit any image data during a still-picture image period. That is, the image supplying apparatus does not transmit the same image data during the still-picture image period. Then, the image supplying apparatus restarts the transmission of image data after the still-picture image period.

The color conversion unit 41 converts the image data acquired by the frame image acquisition unit 40 into a brightness level value Y and color difference data. That is, the color conversion unit 41 does not perform color conversion processing if the acquired image data is YCbCr data, whereas the color conversion unit 41 performs color conversion processing if the acquired image data is RGB data. For example, the color conversion unit 41 converts RGB data into YCbCr data by performing computation in accordance with the following conversion formula (1).

$$Y=0.299R+0.587G+0.114B$$

$$Cb=-0.1684R-0.3316G+0.5000B$$

$$Cr=0.5000R-0.4187G-0.0813B \quad (1)$$

The color conversion unit 41 may store the result of conversion in accordance with the formula (1) above in a color conversion table that is represented in each gradation value of RGB (e.g., from 0 to 255) in advance. In such a case, the color conversion unit 41 converts the pre-conversion data into values represented by, for example, two hundred fifty-six (256) gradations (eight bits) while looking up the color conversion table. The image data processed by the color conversion unit 41 is stored in the frame memory 42. The frame memory 42 stores image data for one picture.

Figure 3A:
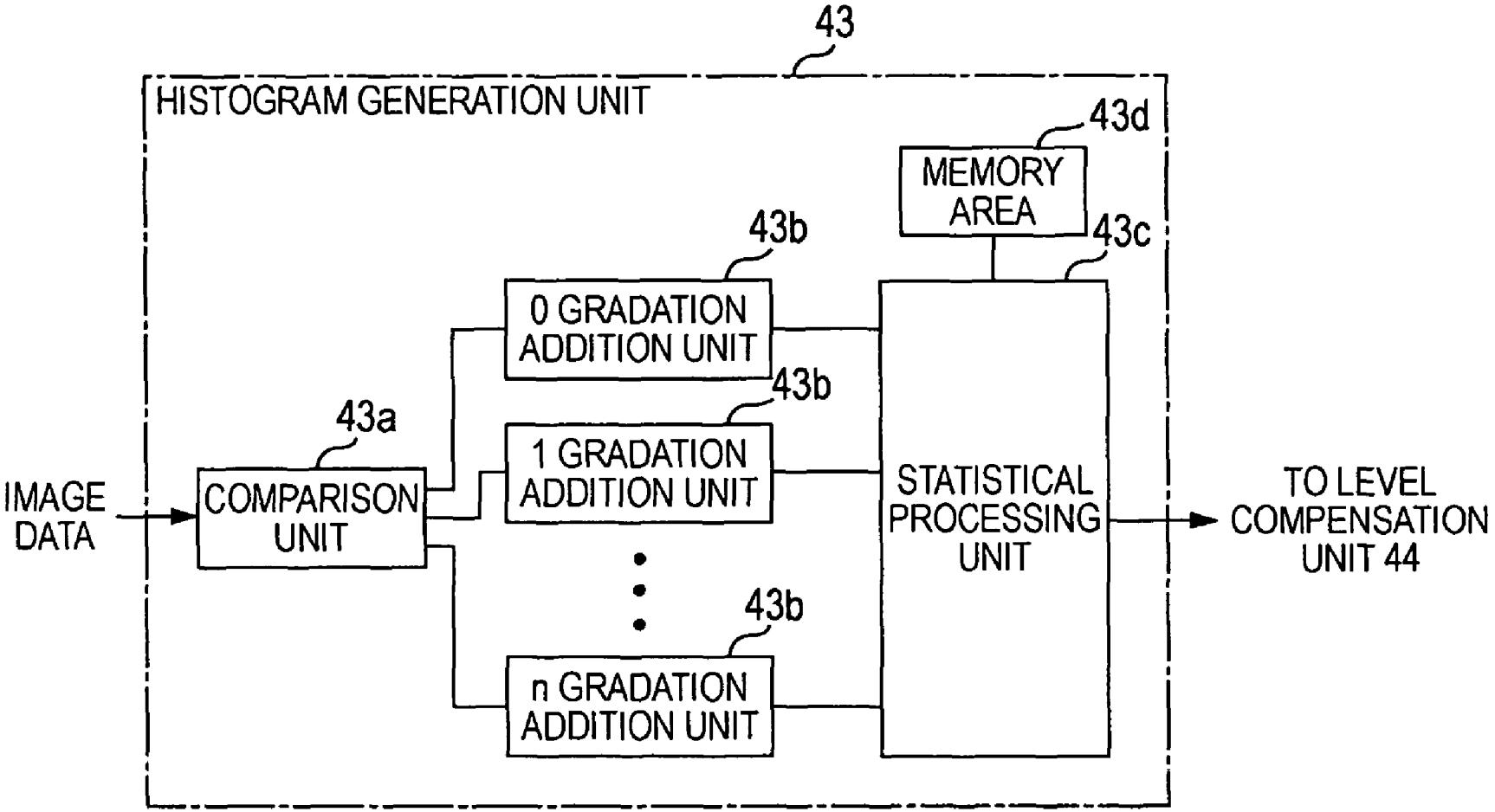
Figure 3B:
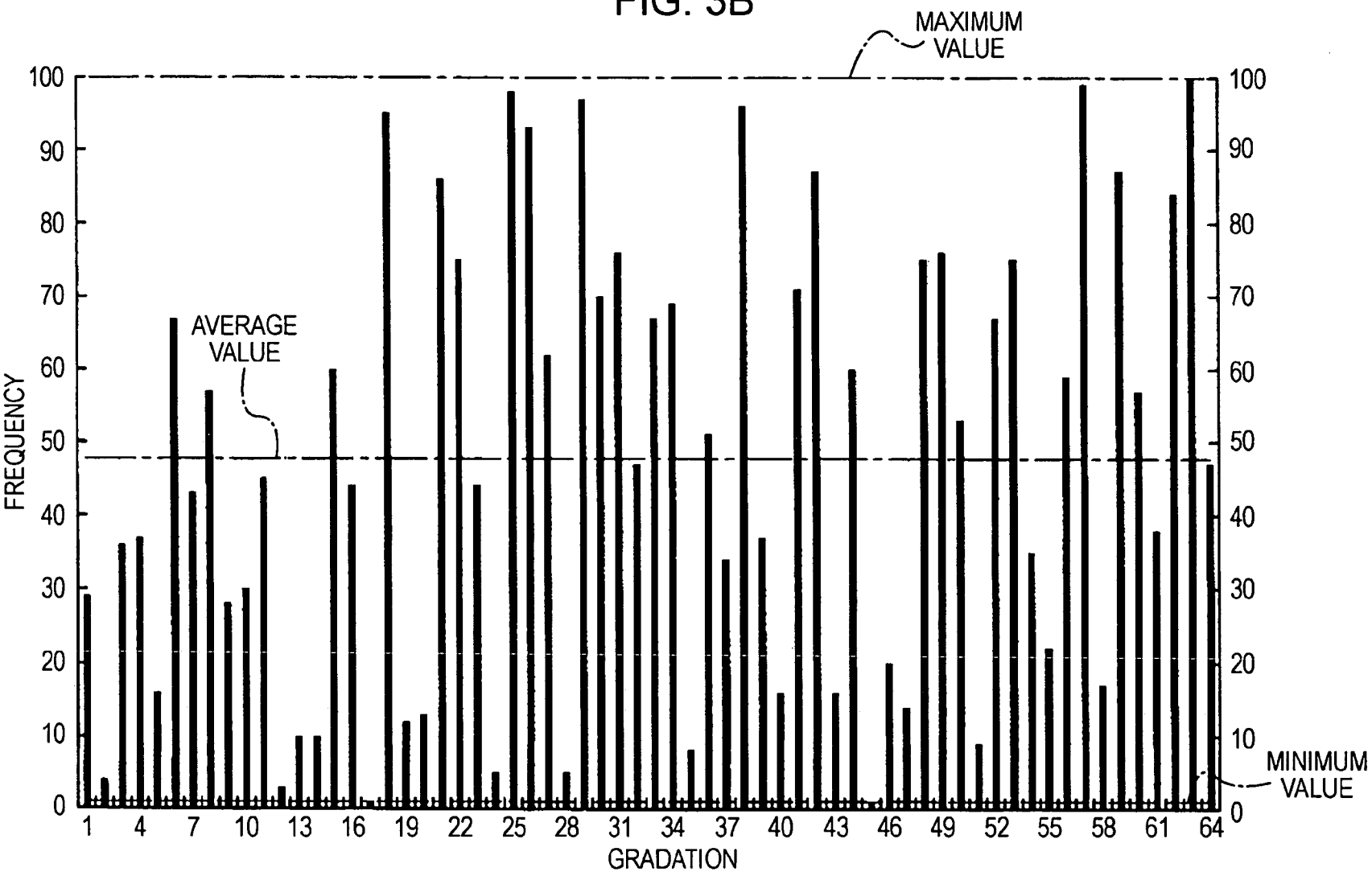
FIG. 3B illustrates an example of a histogram in sixty-four gradations.

The histogram generation unit 43 calculates a histogram on the brightness level values Y of frame images. In the histogram generation unit 43, as illustrated in FIG. 3A, a comparison unit 43*a* makes a judgment as to which gradation the brightness level value Y of the image belongs to. The decision of the judgment is then subjected to addition processing performed by the corresponding gradation addition unit 43*b*. Then, a statistical processing unit 43*c* produces a histogram as illustrated in FIG. 3B, the horizontal axis of which represents gradations and the vertical axis of which represents frequencies, by means of the addition result outputted from the gradation addition unit 43*b*. In addition, the statistical processing unit 43*c* calculates predefined distribution characteristic values such as a maximum value, a minimum value, an average value, and the like. Note that FIG. 3B shows a case of sixty-four (64) gradations.

The histogram generation unit 43 stores the distribution characteristic values that are calculated in this way into a predetermined memory area 43*d* as a statistical computation result. When an operation stop instruction is inputted into the histogram generation unit 43 from the judgment unit 50, each of the comparison unit 43*a* and the gradation addition unit 43 stops its operation. Upon reception of the same operation stop instruction, the statistical processing unit 43*c* also stops its statistical computation after storing the statistical computation result such as the distribution characteristic values and the like into the memory area 43*d*. It should be particularly mentioned that the memory area 43*d* is configured to be capable of storing memory information even during such a pause state. Upon discontinuance of inputs of the operation stop instruction, the histogram generation unit 43 returns to its operation state.

On the basis of the distribution characteristic values such as the maximum value, the minimum value, and the like, which have been calculated by the histogram generation unit 43 and stored in the memory area 43*d*, the level compensation/correction unit 44 performs level compensation/correction (hereafter collectively referred to as "(level) correction") processing by means of a predetermined function so as to widen a range in which the brightness level values Y are distributed. By this means, the level correction unit 44 enhances the contrast of the frame image. On the basis of a luminosity compensation/correction amount that is determined on the basis of a difference between a predetermined brightness standard value and the average value of the brightness level values Y, the distribution characteristic values such as the maximum value, the minimum value, and the like of the brightness level values Y, though not limited to these factors, the luminosity compensation/correction unit 45 performs luminosity compensation/correction (hereafter correctively referred to as "luminosity correction") processing by means of a predetermined function so as to make the compensated/corrected value closer to a predetermined luminosity level. In this way, the luminosity correction unit 45 performs luminosity correction processing so as to make any deviation of the brightness level values of the image data smaller and to decrease any change in brightness that occurs on a display image due to light control.

On the basis of the luminosity correction amount that is used by the luminosity correction unit 45, the average value and the average color difference of the brightness level values Y, and the distribution characteristic values such as the maximum value, the minimum value, and the like of the brightness level values Y, though not limited to these factors, the light control factor computation unit 46 calculates a light control factor of the backlight 32 that does not impair the apparent luminosity of the image displayed on the screen by means of a predetermined function. The time filtering unit 47 performs low-pass filter processing on the brightness level value that is compensated/corrected (hereafter collectively referred to as "corrected") by the luminosity correction unit 45 and also on the light control factor of the backlight 32 calculated by light control factor computation unit 46 by means of a corresponding time constant, that is, by means of one time constant for the brightness level value and another different time constant for the light control factor, so as to achieve "smoothing" thereof while tolerating a steep change. Upon reception of an operation stop instruction that is inputted from the judgment unit 50, the time filtering unit 47 stops its low-pass filter processing. Upon discontinuance of inputs of the operation stop instruction, the time filtering unit 47 returns to its operation state.

The image display signal generation unit 48 generates an image display signal that has been subjected to the level correction and the luminosity correction by means of the brightness level value that has been subjected to the filter processing at the time filtering unit 47. On the other hand, the light source control unit (backlight control unit) 49 controls the amount of light that is emitted by the backlight 32 (the amount of light that is emitted from a light source, or light-source light amount), which is achieved by controlling power supplied by the power supply unit 31 to the backlight 32 by means of the light control factor that has been subjected to the filter processing at the time filtering unit 47. Then, while establishing synchronization with timing at which the light source control unit 49 controls the light source, the image display signal generation unit 48 transmits the generated image display signal to the display panel 30. Then, on the basis of the received image display signal, the display panel 30 modulates light that has been emitted by the backlight 32 so as to control the amount of light transmission for each pixel, thereby displaying an image on the screen thereof.

The judgment unit 50 is made up of a command judgment unit 50*a* and a counter unit 50*b*. The counter unit 50*b* is made up of, for example, an address counter and a counter circuit. The command judgment unit 50*a* accepts the input of the frame image that has been acquired by the frame image acquisition unit 40, and in addition, the image mode and the data amount attached thereto. If the received image mode indicates the still-picture mode, the command judgment unit 50*a* performs, on the inputted image data, a search/detection of a write-in control command WR that approves writing into the frame memory 42 for each frame image where the write-in control command WR is attached at the heading/headmost portion thereof. When the input of the write-in control command WR is found, using it as a trigger, the command judgment unit 50*a* starts the counting of the image data at the address counter. At the address counter, the counter circuit is activated when the count value of the image data amounts to a value equivalent to the amount of notified frame image data. When the count value of the counter circuit reaches a specified value for outputting an operation stop instruction, the judgment unit 50 issues the operation stop instruction to the histogram generation unit 43 and the time filtering unit 47. The above-mentioned specified value for outputting the operation stop instruction is set into an amount/level that corresponds to time required for completing the computation processing that is performed by the histogram generation unit 43 on the frame image data of the still-picture image in addition to time required for completing the filtering processing that is performed by the time filtering unit 47 on the light control factor and the image data that has been corrected by means of the statistical computation result of the histogram generation unit 43.

Figure 4:
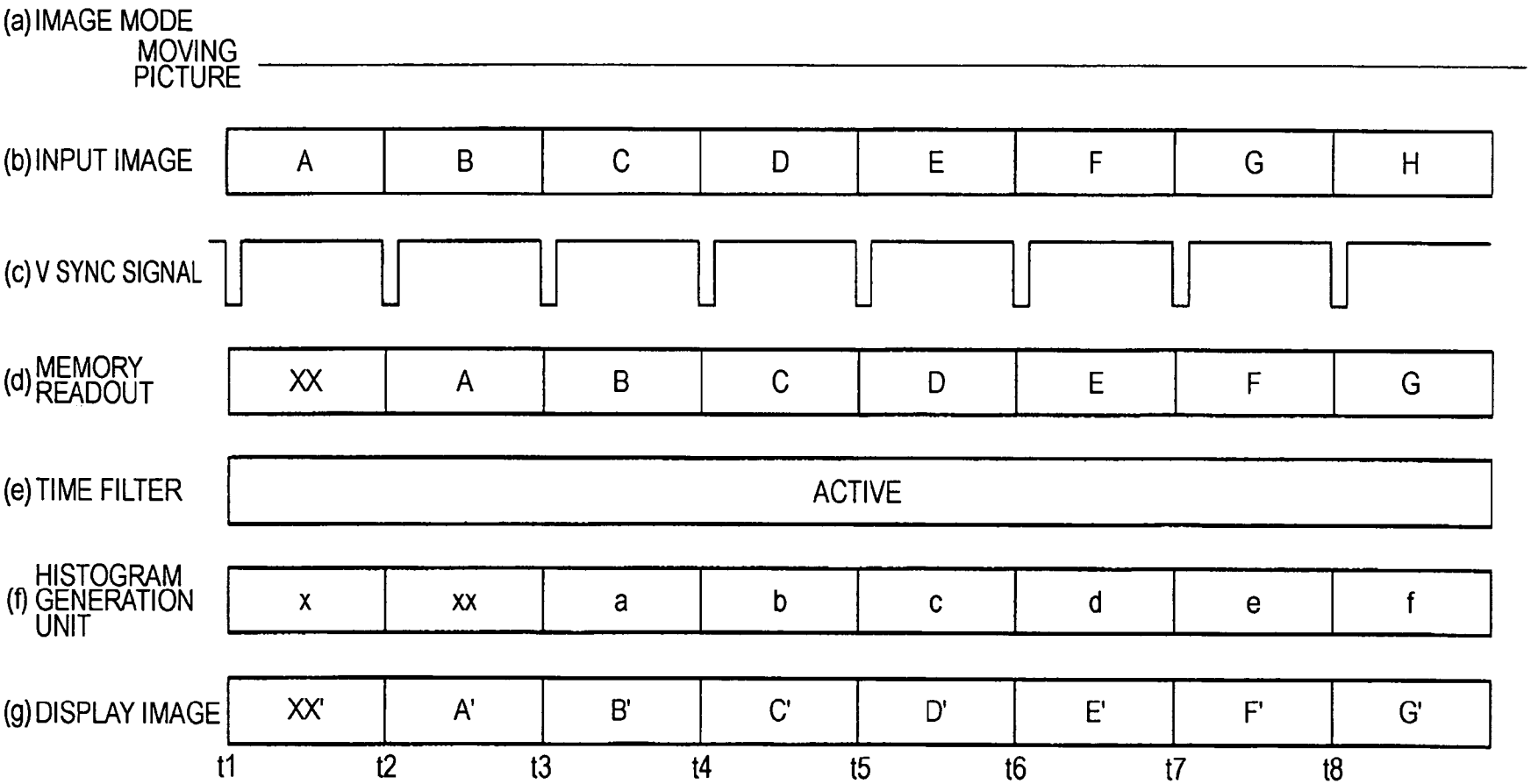
FIG. 4 is a timing chart that explains the operations of respective components of the apparatus in a moving-picture mode.
Figure 5:
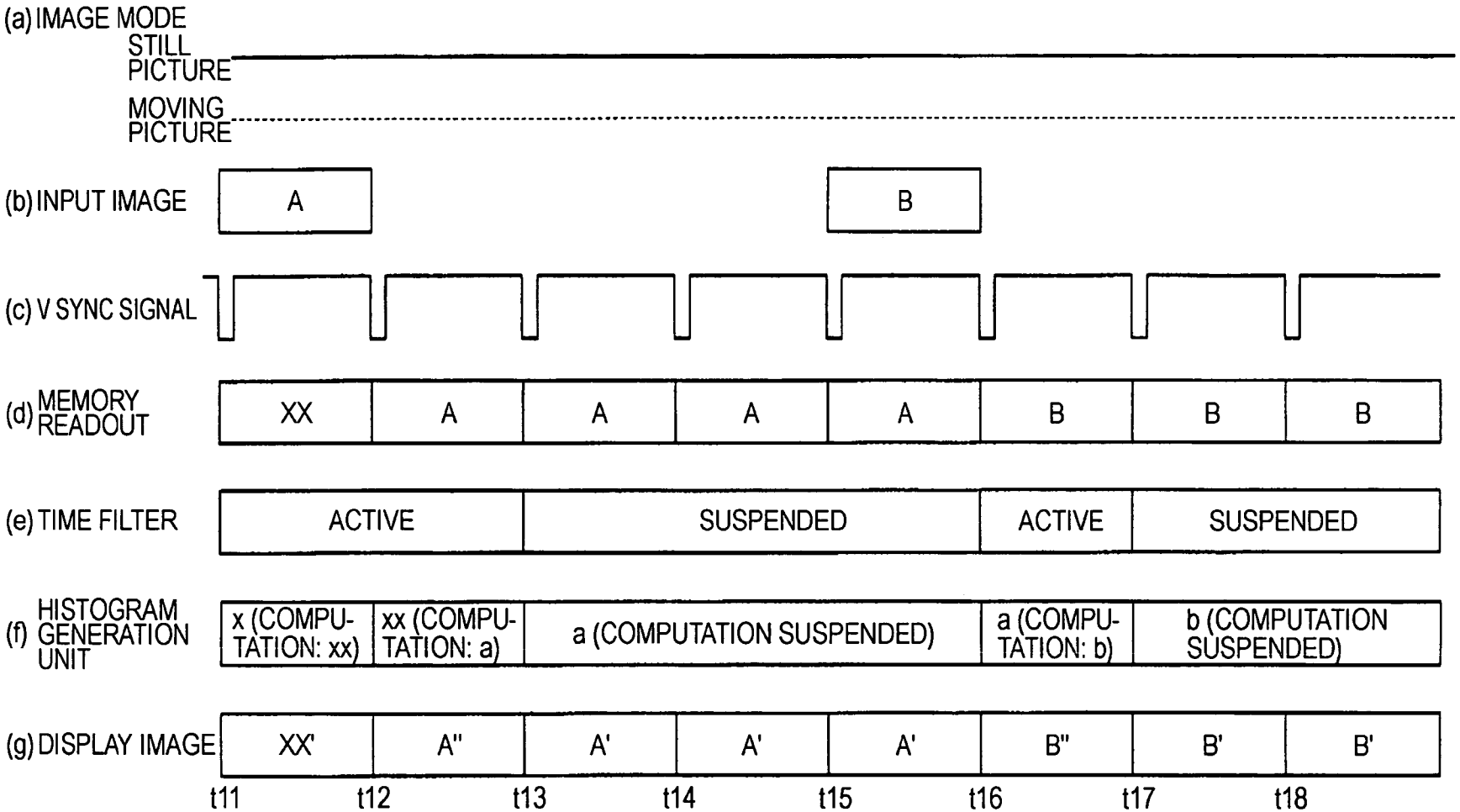
FIG. 5 is a timing chart that explains the operations of respective components of the apparatus in a still-picture mode.

On the other hand, if the received image mode does not indicate the still-picture mode, the command judgment unit 50*a* recognizes it as a moving-picture-mode image. If so, the command judgment unit 50*a* causes the counter unit 50*b* to terminate the outputting of the operation stop instructions; and in such a case, the counting of the image data or the like is not performed. Next, with reference to timing charts illustrated in FIGS. 4 and 5, the operations of the image display apparatus 1 described above are explained below. In FIGS. 4 and 5, the reference numeral (a) denotes an image mode that indicates whether an image signal is a still-picture signal or a moving-picture signal. Specifically, in these drawings, the lower level of the image mode (a) indicates the moving-picture image whereas the higher level thereof indicates the still-picture signal. The reference numeral (b) denotes frame images of an inputted image signal. The reference numeral (c) denotes a vertical synchronization signal. The reference numeral (d) denotes frame images that are read out of the frame memory 42. The reference numeral (e) denotes the operating state of the time filtering unit 47. The reference numeral (f) explains base frame images that are respectively used as a basis of computation of the corresponding statistical computation results held by the histogram generation unit 43. Finally, the reference numeral (g) explains base frame images that correspond to images displayed on the display panel 30, respectively.

When an image is inputted from the image supplying apparatus such as the digital video camera 20, the digital still camera 21, or the like, the image signal, the image mode, and the data amount are inputted into the frame image acquisition unit 40. The frame image acquisition unit 40 acquires the inputted frame image, which is outputted to the color conversion unit 41. At the same time, the frame image acquisition unit 40 inputs the image signal, the image mode, and the data amount into the judgment unit 50. The judgment unit 50 makes a judgment on the received image mode. If it indicates the moving-picture-image mode, the judgment unit 50 does not activate the counter unit 50*b*. Accordingly, the operation stop instruction is not issued in such a case.

After being subjected to the color conversion processing that is performed by the color conversion unit 41, the image data of the (current) frame image is temporarily stored into the frame memory 42. Thereafter, it is read out of the frame memory 42 in a sequential manner. On the basis of the statistical computation result such as the distribution characteristic values and the like that has been calculated on the basis of the previous frame image and then stored in the memory area 43*d*, the level correction unit 44 performs the level correction processing thereon, which is followed by the luminosity correction processing performed by the luminosity correction unit 45, and by the light control factor computation performed by the light control factor computation unit 46. Thereafter, the time filtering unit 47 performs filtering processing on the value corrected by the luminosity correction unit 45 and on the light control factor computed by the light control factor computation unit 46. Then, on the basis of the image data that has been subjected to the predetermined computation/correction processing described above, the image display signal generation unit 48 generates an image display signal so that image display is performed on the basis of the generated image display signal. On the other hand, the backlight control unit 49 controls the amount of light that is emitted from the backlight 32 in accordance with the light control factor. In separate processing that is performed in parallel/concurrent with the above series of processing, the histogram generation unit 43 performs, on the basis of the image data that is held by the frame memory 42, the generation of a histogram, the computation of distribution characteristic values, and the like.

As illustrated in FIG. 4, upon receiving data inputs of frame images A, B, C, and D in the order of appearance herein, the image data of these frame images are sequentially stored into the frame memory 42. At the point in time when the image data of the frame image A is read out of the frame memory 42 at t2 in the illustrated frame-update cycle, the statistical computation result such as the distribution characteristic values and the like to be calculated on the basis of the frame image A at the histogram generation unit 43 has not yet been obtained. For this reason, level correction processing is performed on the frame image A on the basis of the statistical computation result "xx" that has already been calculated on the basis of the immediately preceding frame image XX, which is followed by luminosity correction processing, and the like. As a result thereof, the image A' that corresponds to the frame image A is displayed.

During a time period in which the above-described series of processing for displaying the frame image A is performed, the histogram generation unit 43 generates a histogram on the basis of the frame image A that is currently stored in the frame memory 42 so as to obtain a predetermined statistical computation result. Then, at the next time point t3 in the frame-update cycle, that is, when the frame image B is read out of the frame memory 42, level correction processing and the like are performed on the frame image B on the basis of the statistical computation result "a" that has already been calculated on the basis of the frame image A. As a result thereof, the image B' that corresponds to the frame image B is displayed.

During a time period in which the above-described series of processing for displaying the frame image B is performed, the histogram generation unit 43 generates a histogram on the basis of the frame image B that is currently stored in the frame memory 42 so as to obtain a predetermined statistical computation result. Subsequently, the same series of processing as described above is performed on the frame image C, D, . . . in a sequential manner. To sum it up, the level correction processing and other processing for image display is performed for each frame image on the basis of the statistical computation result that has already been calculated on the basis of its immediately preceding frame image; in addition thereto, the amount of light that is emitted from the light source, which is a backlight herein, is decreased in accordance with the brightness of the frame image, thereby making it possible to reduce power consumption of the apparatus.

Next, it is assumed for the purpose of explanation that the type of the input image changes from a moving picture, which is explained above, to a still picture. For still-picture display, the image supplying apparatus transmits an image signal of the frame image A, which is assumed to be a still picture, with its image mode being set in a still-picture mode. Confirming that the image mode of the received image indicates a still-picture mode, the judgment unit 50 then checks if there is a write-in control command WR contained in the image data that has been inputted from the frame image acquisition unit 40. When the write-in control command WR is detected, the judgment unit 50 recognizes that it is the headmost image data of one frame image. Then, the judgment unit 50 starts the counting of image data that is performed by the address counter of the counter unit 50*b*. The counter circuit is activated when the count value of the image data at the address counter amounts to the specified activation value. When the count value of the counter circuit reaches the specified value for outputting an operation stop instruction, the judgment unit 50 issues the operation stop instruction to the histogram generation unit 43 and the time filtering unit 47.

After the image data of the immediately preceding frame image XX has been read out of the frame memory 42 at a point in time t11 in the illustrated frame-update cycle, the image data of the frame image A is stored into the frame memory 42. Next, at a point in time t12 in the frame-update cycle, the image data of the frame image A is read out of the frame memory 42. Then, level correction processing and the like are performed on the frame image A on the basis of the statistical computation result "xx" that has already been calculated on the basis of the immediately preceding frame image XX. As a result thereof, the image A" that corresponds to the frame image A, which has been subjected to the level correction processing and the like on the basis of the statistical computation result xx, is displayed.

In separate processing that is performed in parallel/concurrent with the above series of processing, the histogram generation unit 43 generates, on the basis of the image data that is written in the frame memory 42, a histogram and then computes the distribution characteristic values thereof, thereby obtaining a predetermined statistical computation result. Then, after storing the statistical computation result such as the distribution characteristic values "a" for the frame image A, which is assumed to be a still picture in the present context, into the predetermined memory area 43*d*, the judgment unit 50 issues an operation stop instruction. Upon issuance of the operation stop instruction, each of the comparison unit 43*a*, the gradation addition unit 43*b*, and the statistical processing unit 43*c* suspends (i.e., stops) its operation. Even during a time period in which the operations of the comparison unit 43*a*, the gradation addition unit 43*b*, and the statistical processing unit 43*c* are suspended, the statistical computation result "a" held in the memory area 43*d* is kept in memory.

Upon completion of filter processing that is performed by the time filtering unit 47 on the image data of the still-picture frame image A that has been subjected to the level correction and the luminosity correction and also performed on the computed light control factor, the judgment unit 50 issues an operation stop instruction. The filter processing of the time filtering unit 47 is suspended upon reception of the operation stop instruction. Since there is not any input of a new frame image at the point in time t12 in the frame-update cycle, the image data of the still-picture frame image A remains in the frame memory 42.

Subsequently, at the next point in time t13 in the frame-update cycle, the frame image that is currently stored in the frame memory 42, that is, the image data of the frame image A, is read out of the frame memory 42. Then, level correction processing and other processing for image display is performed by means of the statistical computation result that is stored in the memory area 43*d*, that is, the statistical computation result "a" of the frame image A. As a result thereof, the image A' that corresponds to the frame image A, which has been subjected to the level correction processing and the like on the basis of the statistical computation result "a", is displayed. It follows that no filter processing is performed on the corrected image data and the computed light control factor thereof because the time filtering unit 47 is in a suspended state at this point in time. In spite of omission of the filter processing, however, because both of the image A' that is displayed at the point in time t13 in the frame-update cycle and the image A" that is displayed at the point in time t12 in the frame-update cycle correspond to the frame image A, there is not so much difference between the corrected image data of the former and that of the latter. On one hand, the image data of the frame image A is compensated/corrected by means of the statistical computation result xx on the basis of the frame image XX. On the other hand, the image data of the frame image A is compensated/corrected by means of the statistical computation result "a" on the basis of the frame image A. If there is any significant difference between the image data of the frame image XX and the image data of the frame image A, such a difference will be reflected as a corresponding difference between the statistical computation result xx and the statistical computation result "a", which will eventually appear as a corresponding difference between the corrected image A" and the corrected image A'. For this reason, there is no problem in omitting the filter processing.

Subsequently, at the next point in time t14 in the frame-update cycle, as done at the preceding point in time t13, the image A' is displayed on the basis of the image data of the frame image A that is stored in the frame memory 42 and further on the basis of the statistical computation result "a" that is stored in the memory area 43*d*. Thereafter, at the next point in time t15 in the frame-update cycle at which the still picture is switched over from the frame image A into the frame image B, the image signal of the frame image B as well as its image mode, data amount, and the like is inputted from the image supplying apparatus. Detecting the input of the new frame image, the judgment unit 50 discontinues the outputting of the operation stop instruction to the histogram generation unit 43 and the time filtering unit 47. Since the inputted image mode indicates the still-picture mode, the address counter of the counter unit 50*b* starts the counting of image data, which is triggered at the timing of detection of the write-in control command WR. The counter circuit is activated when the count value of the image data at the address counter amounts to the specified activation value. When the count value of the counter circuit reaches the specified value for outputting an operation stop instruction, the judgment unit 50 issues the operation stop instruction.

On the other hand, the image data of the frame image A that is stored in the frame memory 42 is read out at the point in time t15 in the frame-update cycle. Thereafter, level correction processing and the like are performed by means of the statistical computation result "aa" that is stored in the memory area 43*d* so as to display the image A1 on the basis of the statistical computation result "a"; in addition thereto, the next frame image B is written into the frame memory 42. Next, the image data of the frame image B that is stored in the frame memory 42 is read out at the point in time t16 in the frame-update cycle. Thereafter, predetermined correction processing and the like are performed thereon by means of the statistical computation result "a" on the basis of the frame image A. After filter processing that is performed by the time filtering unit 47, which has now returned to its operating state, the image B" is displayed. At a point in time after completion of the filter processing performed on the still-picture frame image B by the time filtering unit 47, the judgment unit 50 issues an operation stop instruction. Upon reception of the operation stop instruction, the time filtering unit 47 suspends its filter processing again.

The histogram generation unit 43, which has now returned to its operating state, performs a predetermined computation on the basis of the frame image B that is written in the frame memory 42 so as to acquire the statistical computation result "b". At a point in time after storing the statistical computation result "b" into the memory area 43*d*, the judgment unit 50 issues an operation stop instruction. Upon reception of the operation stop instruction, the histogram generation unit 43 suspends the operations of its inner components again.

Subsequently, at the next point in time t17 in the frame-update cycle, the still-picture frame image B is read out of the frame memory 42 because the frame B remains therein at this point. Then, level correction processing and the like are performed on the frame image B on the basis of the statistical computation result "b" that is stored in the memory area 43*d* of the histogram generation unit 43 that is now in a suspended state. As a result thereof, the image B' that corresponds to the frame image B, which has been subjected to the level correction processing and the like on the basis of the statistical computation result "b", is displayed. At this time, no filter processing is performed thereon because the time filtering unit 47 is now in a suspended state. The same series of processing as that performed in the time t17 is performed at the next point in time t18 in the frame-update cycle. That is, predetermined correction processing is performed on the frame image B of the frame memory 42 on the basis of the statistical computation result "b". As a result thereof, the image B' that corresponds to the frame image B is displayed.

Referring to the frame-update cyclic period from the point in time t13 inclusive through the point in time t16 exclusive (i.e., time periods t13, t14, and t15), which is a consecutive time period after calculation of the statistical computation result such as the distribution characteristic values and the like of the still-picture frame image A, as has already been described above, the histogram generation unit 43 performs the data-retaining of the statistical computation result stored in the memory area 43*d* only, which means that other processing thereof is suspended during this period. The same holds true for the time t17 and t18, which is a consecutive time period after calculation of the statistical computation result of the still-picture frame image B. In each of the above time periods, the operations of the time filtering unit 47 are also suspended. For this reason, it is possible to reduce power consumption of the apparatus because of the suspended operations of the histogram generation unit 47 and the time filtering unit 47. It should be noted that no updating of the frame image could occur during such an operation suspension period because the image is still-picture one. For this reason, there is no change in the statistical computation result such as the distribution characteristic values and the like during this period. Therefore, though the calculation of distribution computation/correction values and the like is omitted during this period, it does not pose any problem. In addition, since no change could occur in image data after the luminosity correction or in the light control factor during this period, the filter processing can be omitted without causing any problem.

In the exemplary embodiment of the invention described herein, image mode information, which indicates whether image data is still-picture one or not, is pre-attached thereto at the image supplying apparatus that supplies an image signal, where the image supplying apparatus knows the type of the image data in advance, that is, either still-picture data or moving-picture data. The image display apparatus 1 makes a judgment as to whether the received image data is a still picture or a moving picture by referring to the image mode information. Such a configuration makes it possible for the image display apparatus 1 to makes a judgment as to whether the received image data is a still picture or a moving picture in an easy manner. In addition thereto, such a configuration can be implemented without increasing a significant burden on the image supplying apparatus. Although the image mode is notified from the image supplying apparatus to the image display apparatus 1 in the exemplary embodiment of the invention described herein, the invention is not limited to such a configuration. For example, the image display apparatus 1 may judge whether the received image data is a still picture or a moving picture by checking the change status of the received image data between one frame and another.

Figure 6:
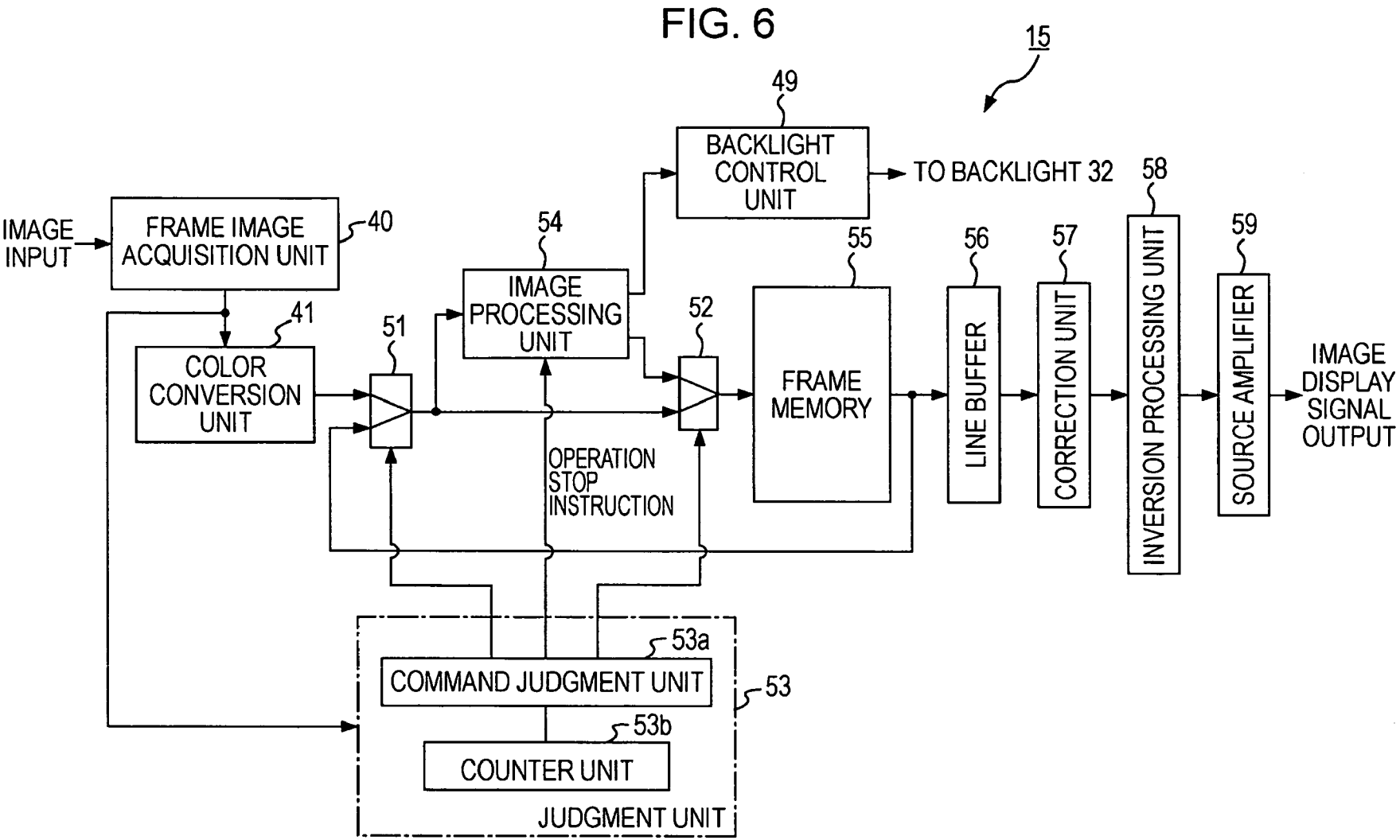
FIG. 6 is a block diagram that schematically illustrates an example of the configuration of an image processing engine according to a second embodiment of the invention.

Next, with reference to the accompanying drawings, a second exemplary embodiment of the invention is explained below. Except for the configuration of the image processing engine 15, the second exemplary embodiment of the invention is the same as the first exemplary embodiment of the invention described above. Accordingly, in the following description, the same reference numerals are consistently used for the same components as those described in the first exemplary embodiment of the invention so as to omit any redundant explanation thereof. FIG. 6 is a block diagram that schematically illustrates an example of the configuration of the image processing engine 15 according to the second embodiment of the invention. As illustrated in FIG. 6, the image processing engine 15 according to the second embodiment of the invention is provided with the frame image acquisition unit 40, the color conversion unit 41, switching units 51 and 52, a judgment unit 53, an image processing unit 54, a frame memory 55, a line buffer 56, a γ correction unit 57, an inversion processing unit 58, a source amplifier 59, and the backlight control unit 49. In such a configuration, a block of components that include the line buffer 56, the γ correction unit 57, the inversion processing unit 58, and the source amplifier 59 corresponds to an image display section. The switching unit 51 accepts either one of two input sources, that is, either image data that is supplied from the color conversion unit 41 or image data that is looped back from the frame memory 55. On the other hand, the switching unit 52 accepts either one of two input sources, that is, either an output coming from the switching unit 51 or an output coming from the image processing unit 54. Then, the switching unit 52 outputs the selected one input to the frame memory 55.

Each of the frame image acquisition unit 40, the color conversion unit 41, and the backlight control unit 49 performs the same function as that of the first embodiment of the invention described above. In addition, each of the image supplying apparatuses according to the second embodiment of the invention, which supplies an image signal, transmits an image signal together with image mode information, which indicates whether the transmitted image data is in a still-picture mode, and data amount information that indicates the amount of image data for one frame image, where such image mode information and data amount information are added to the image signal.

The judgment unit 53 has a command judgment unit 53*a* and a counter unit 53*b*. The command judgment unit 53*a* makes a judgment as to whether the received image signal is in a still-picture mode or not on the basis of the mode information supplied from the frame image acquisition unit 40. If the command judgment unit 53*a* judges that the received image is in a moving-picture mode, a normal input route side of the switching unit 51 is activated so as to accept an input of image data supplied from the color conversion unit 41, while activating a normal input route side of the switching unit 52 so as to accept an input coming from the image processing unit 54 and then output it to the frame memory 55. Then, triggered by a write-in control command WR that is attached at the front portion of the image data that is sent from the frame image acquisition unit 40, the judgment unit 53 causes the address counter of the counter unit 53*b* to start the counting of the image data. When the count value of the address counter amounts to a value equivalent to the amount of image data notified from the image supplying apparatus, the switching unit 51 is switched over to its loop-side route connection so as to accept an input of image data that is read out of the frame memory 55. Therefore, image data that is inputted from the color conversion unit 41 goes through the switching unit 51, the image processing unit 54, the switching unit 52, and then written into the frame memory 55; and then, it is read out of the frame memory 55 to be looped back to the switching unit 51. Subsequently, the image data is inputted again into the image processing unit 54 at which it is subjected to correction. Thereafter, the image data passes through the switching unit 52 to be written into the frame memory 55. Then, the image data is read out of the frame memory 55 on a line-by-line basis. Thereafter, the image data passes through the line buffer 56, the γ correction unit 57, the inversion processing unit 58, and the source amplifier 59 to be subjected to known γ correction and inversion processing thereat. After the above series of processing, the image data is outputted as an image display signal so that image display is performed.

On the other hand, if the received image is judged to be in a still-picture mode, each of the switching units 51 and 52 is set into its normal route connection. Then, triggered by the write-in control command WR, the address counter of the counter unit 53*b* counts the number of image data so as to judge whether image data for one still-picture frame has been read or not. When the count value of the address counter amounts to a value equivalent to the amount of image data for one still-picture frame, the switching unit 51 is switched over to its loop-side route connection; and in addition, the counter circuit is activated. When the count value of the counter circuit reaches the specified value for outputting an operation stop instruction, the judgment unit 53 issues the operation stop instruction to the image processing unit 54 while switching the switching unit 52 over to its loop-side route connection so as to accept data that is inputted from the switching unit 51. The above-mentioned specified value for outputting the operation stop instruction is set into an amount/level that corresponds to time required for completing predetermined correction processing performed by the image processing unit 54 on the image data that corresponds to the still-picture frame image that has been corrected by means of the statistical computation result, and in addition thereto, time required for completing the writing of the compensated/corrected image data into the frame memory 55. Upon reception of a new image data from the frame image acquisition unit 40, the judgment unit 53 discontinues the outputting of the operation stop instruction to the image processing unit 54.

Figure 7:
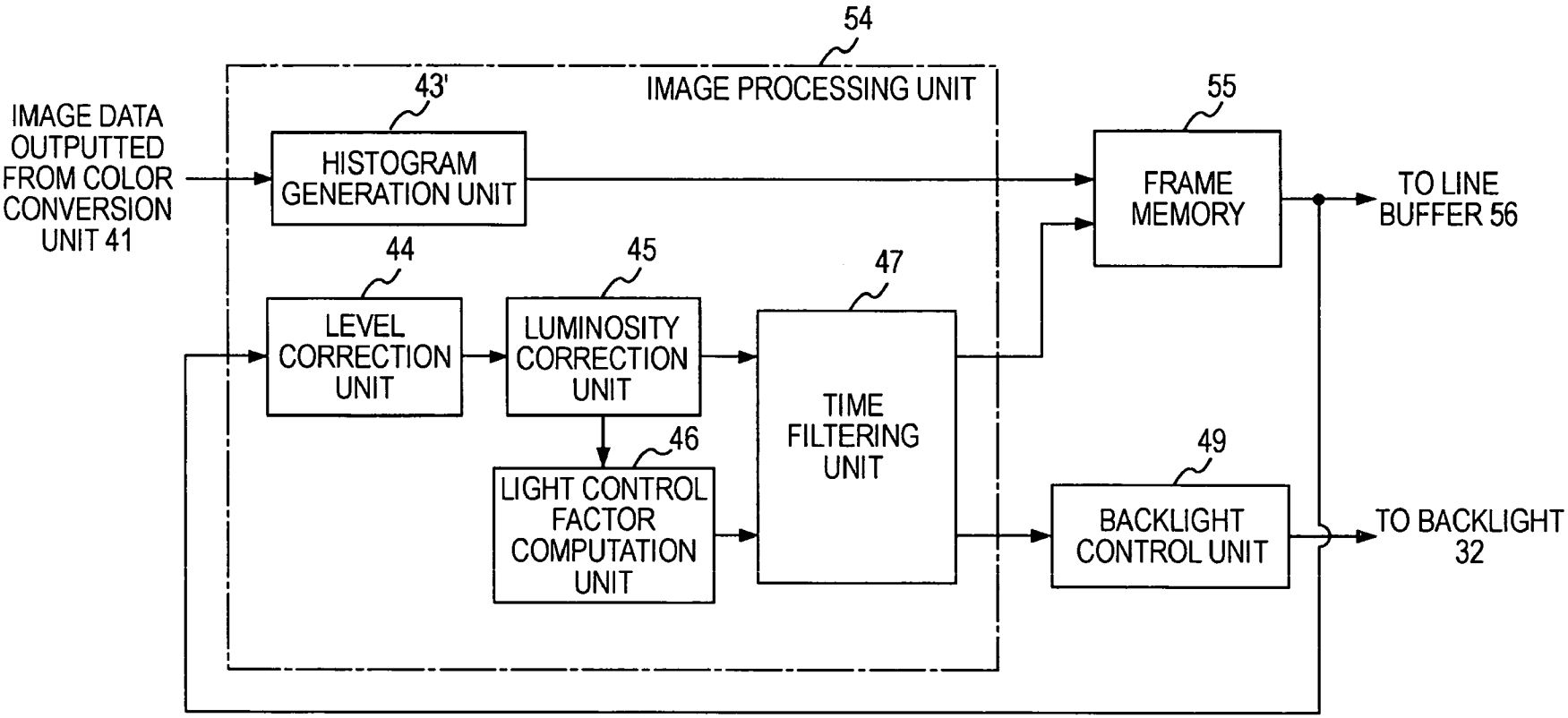
FIG. 7 is a block diagram that schematically illustrates an example of the configuration of an image processing unit that is illustrated in FIG. 6.

As illustrated in FIG. 7, the image processing unit 54 is provided with a histogram generation unit 43', the level correction unit 44, the luminosity correction unit 45, the light control factor computation unit 46, and the time filtering unit 47. Each of these components has the same function as that of the first embodiment of the invention described above. However, in the present embodiment of the invention, image data outputted from the color conversion unit 41 is inputted into the histogram generation unit 43' of the image processing unit 54. The histogram generation unit 43' performs the generation of the histogram described above and the calculation of the distribution characteristic values described above on the basis of the inputted image data. In addition, the histogram generation unit 43' writes the image data into the frame memory 55. The image data read out of the frame memory 55 is inputted into the level correction unit 44. After being subjected to filter processing at the time filtering unit 47, the image data is written into the frame memory 55. Then, the image data passes through the line buffer 56, the γ correction unit 57, the inversion processing unit 58, and the source amplifier 59 so as to be outputted as an image display signal. On the basis of the generated image display signal, image display is performed. Upon reception of an operation stop instruction from the judgment unit 53, the image processing unit 54 suspends its operation except that the statistical computation result held in the memory area 43*d* of the histogram generation unit 43' is kept in memory. The suspended histogram generation unit 43' returns to its operating state upon discontinuance of inputs of the operation stop instruction. On the other hand, the light control factor that is filter-processed by the time filtering unit 47 is inputted into the backlight control unit 49. On the basis of the inputted light control factor, the (light-source) amount of the backlight 32 is controlled.

Next, the operations of the second exemplary embodiment of the invention are explained below. An image signal whose attached image mode information indicates a moving-picture mode is inputted from the image supplying apparatus. Upon reception of the input thereof, the frame image acquisition unit 40 acquires a frame image A, which is outputted to the color conversion unit 41. On the other hand, image data D (A) of the frame image A, image mode information, and data amount information are inputted into the judgment unit 53. Since the image mode indicates the moving-picture mode, the judgment unit 53 sets each of the switching units 51 and 52 into its normal route connection. Using the write-in control command WR as a trigger, the counter unit 53*b* starts the counting of the image data D (A). When the counter unit 53*b* judges that the acquisition of the image data D (A) for one frame has now been completed, the switching unit is switched over to its loop-back route connection.

On the other hand, the image data D (A) of the frame image A that is acquired by the frame image acquisition unit 40 is then subjected to predetermined conversion processing at the color conversion unit 41. Thereafter, the converted data passes through the switching unit 51, which is now set in its normal route side, and then is inputted into the image processing unit 54. The image data D (A) that is inputted into the image processing unit 54 enters the histogram generation unit 43'. While writing the received image data D (A) as it is, or in other words, without applying any processing thereto, into the frame memory 55, the histogram generation unit 43' performs the generation of a histogram and the computation of the distribution characteristic values described above. Then, the histogram generation unit 43' stores the statistical computation result "a", which is based on the frame image A, into the memory area 43*d*.

Thereafter, the image data D (A) is read out of the frame memory 55 in a sequential manner to go through the switching unit 51, which is now set in its loop-back route side. After passing through the switching unit 51, the image data D (A) is inputted into the image processing unit 54. The level correction unit 44 performs level correction processing on the image data D (A) that is inputted into the image processing unit 54 on the basis of the statistical computation result "a" that is stored in the memory area 43*d*, which is followed by luminosity correction processing performed by the luminosity correction unit 45. On the other hand, the light control factor computation unit 46 performs the computation of a light control factor thereon. The time filtering unit 47 performs filter processing on the image data D (A)' that has been subjected to the luminosity correction processing and on the computed light control factor. Subsequently, the filter-processed image data D (A)' is stored in the frame memory 55, whereas the filter-processed light control factor is outputted to the back light control unit 49.

Thereafter, the corrected image data D (A)' that is stored in the frame memory 55 is read out thereof. The read-out image data passes through the line buffer 56, the γ correction unit 57, the inversion processing unit 58, and the source amplifier 59 so as to be outputted as an image display signal. Then, image display is performed on the basis of the generated image display signal. By this means, the frame image A is displayed. Upon receiving an input of image data of a frame image B, which is a moving picture, from the frame image acquisition unit 40, the judgment unit 53 switches the switching unit 51 to its normal route connection. Under the above switch route setting, the image data D (B) of the frame image B passes through the switching unit 51, the image processing unit 54, and the switching unit 52 to be stored in the frame memory 55. During the signal flow described above, the histogram generation unit 43' of the image processing unit 54 calculates the statistical computation result "b" on the basis of the image data D (B), and then stores the calculated statistical computation result into the memory area 43*d*.

Receiving the input of the frame image B, the judgment unit 53 starts the counting of the number of image data. When it is judged that the input of image data for one frame has now been completed, the switching unit 51 is switched over to its loop-back route connection. Under the above switch route setting, the image data D (B) that is read out of the frame memory 55 passes through the switching unit 51 to be inputted into the level correction unit 44 of the image processing unit 54. The level correction unit 44 performs level correction processing and the like thereon on the basis of the statistical computation result "b" stored in the memory area 43*d*. Then, the corrected image data D (B)' is written into the frame memory 55 so that image display is performed on the basis thereof. On the other hand, the backlight control unit 49 controls the amount of the light on the basis of the calculated light control factor. In other words, it is controlled into the amount of light that is in accordance with the corrected image data D (B)'.

Thereafter, the above-described series of processing is repeated in synchronization with the frame-update cycle of the display panel 30. By this means, for example, by means of the statistical computation result "a" that is based on the image data D (A) of the frame image A, the image data D (A) itself is corrected into the image data D (A)' so that image display corresponding to the frame image A is performed on the basis of the corrected image data D (A)'. When a still picture is inputted after a series of moving pictures exemplified above, the image supplying apparatus notifies such a picture-type switchover by means of the still-picture mode indication. Confirming that the notified image mode information indicates the still-picture mode, the judgment unit 53 starts the counting of image data while switching the switching unit 51 over to its normal route connection.

A frame image outputted from the color conversion unit 41, for example, image data D (C) of a frame image C goes through the switching unit 51, the image processing unit 54, the switching unit 52, and then written into the frame memory 55. The image processing unit 54 performs the calculation of the distribution characteristic values so that the statistical computation result "c" is stored into the memory area 43*d*. Upon completion of the inputting of the image data D (C) for one frame, the switching unit 51 is switched over to its loop-back route connection. Then, the image data D (C) stored in the frame memory 55 is read out thereof to pass through the switching unit 51 to re-enter the image processing unit 54. After being subjected to the luminosity correction processing and the like thereat, the corrected image data D (C)' is written into the frame memory 55. Then, image display is performed on the basis of the corrected image data D (C)'.

when the count value of the counter unit 53*b* amounts to the specified value for outputting an operation stop instruction, the judgment unit 53 switches the switching unit 52 over to its loop-back route connection while outputting the operation stop instruction to the image processing unit 54. The operation stop instruction is received at the image processing unit 54 at a point in time after completing the writing of the image data D (C)', which has been subjected to predetermined correction processing, into the frame memory 55. Upon reception of the operation stop instruction, the image processing unit 54 enters a suspended state. In addition, each of the switching units 51 and 52 is switched over to its loop-back route connection at this timing.

As the result of the above switchover, a loop made up of the switching unit 51, the switching unit 52, and the frame memory 55 is formed so that the updating of the frame memory 55 is ceased. Then, at the next time unit in the frame-update cycle, the image data D (C)' of the frame memory 55 is read out so that image display corresponding to the frame image C is performed on the basis of the image data D (C)'. In subsequent processing, the image data is read out of the frame memory 55 to the line buffer 56 for each time unit in the frame-update cycle so that image display is performed on the basis thereof.

As explained above, in the second embodiment of the invention, the histogram generation unit 43', which calculates a statistical computation result, and correction units including the level correction unit 44, which perform the aforementioned correction processing on image data, are provided at the upstream of the frame memory 55. In such a configuration, after the inputted image data has been written in the frame memory 55 via the histogram generation unit 43', the stored image data is read out of the frame memory 55 to be subjected to correction; and the corrected image data is stored into the frame memory 55 again. Then, image display is performed by means of the corrected image data. Therefore, since "after-correction" (i.e., corrected) image data is stored in the frame memory 55, image display can be performed by means of the corrected image data that is stored in the frame 55 after writing the still-picture image data, which has been subjected to correction processing, into the frame memory 55 till updating the frame image. This means that there is no problem at all even though the operation of the image processing unit 54, which is in charge of statistical computation and correction processing, is suspended during this time window/period.

Therefore, according to the second embodiment of the invention, it is possible to reduce power consumption of the apparatus by suspending the operation of the image processing unit 54. Specifically, in the configuration according to the second embodiment of the invention, it is possible to suspend not only the operations of the histogram generation unit 43' and the time filtering unit 47 but also the operations of the level correction unit 44, the luminosity correction unit 45, and the light control factor computation unit 46. Thus, advantageously, it is possible to further reduce power consumption of the apparatus. In addition, in the configuration according to the second embodiment of the invention, image data of an inputted frame image is stored into the frame memory 55 so that level correction processing and the like are performed not on the inputted image data directly but on the read-out image data that is outputted from the frame memory 55. Thanks to such a configuration, it is possible to achieve, just with a simple configuration, the advantageous effects of the invention even in such a case where the image data of the frame image is sent from the color conversion unit 41 only once.

Figure 8:
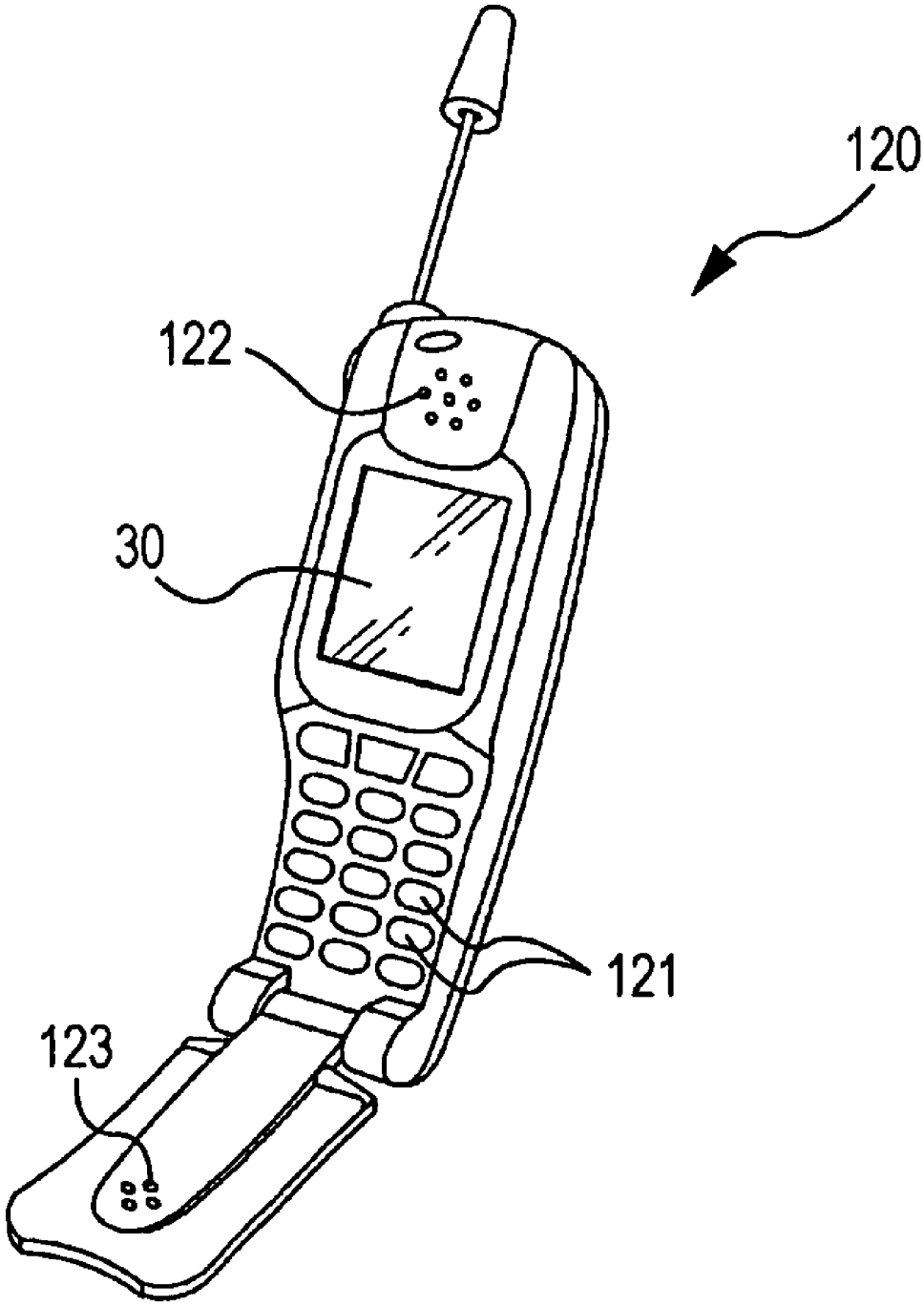
FIG. 8 is a perspective view that schematically illustrates an example of a mobile phone to which the image display apparatus according to the invention is applied.

Next, in the following description, an example of various kinds of electronic apparatuses that has a liquid crystal display device 1 described above is explained. FIG. 8 is a perspective view that schematically illustrates an example of the configuration of a mobile phone 120 to which the liquid crystal display device 1 is applied. As illustrated in the figure, the mobile phone 120 is provided with a plurality of manual operation buttons 121, an earpiece 122, a mouthpiece 123, and the liquid crystal display device 1 described above. Except the display panel 30, constituent elements of the liquid crystal display device 1 do not appear and so not visually recognized because they are configured as inner built-in components of the phone.

Among a variety of electronic apparatuses to which the liquid crystal display device 1 is applicable are, other than the mobile phone illustrated in FIG. 8, a digital still camera, a notebook-sized personal computer, a liquid crystal television, a video recorder of a viewfinder type (or a direct monitor view type), a car navigation device, a pager, an electronic personal organizer, an electronic calculator, a word processor, a workstation, a videophone, a POS terminal, a touch-panel device, and so forth. Needless to say, it is possible to embody the above-described liquid crystal display device 1 as a display device for such a variety of electronic apparatuses.

The histogram generation units 43 and 43' described in the foregoing exemplary embodiments of the invention corresponds to a statistical computation section recited in the appended claims. A combination of the level compensation/correction unit 44 and the luminosity compensation/correction unit 45 described in the foregoing exemplary embodiments of the invention corresponds to a correction section recited in the appended claims. The image display signal generation unit 48 and the backlight control unit 49 described in the foregoing exemplary embodiments of the invention correspond to an image display section and a light source control section recited in the appended claims, respectively. The judgment units 50 and 53 described in the foregoing exemplary embodiments of the invention corresponds to a still picture judgment section recited in the appended claims. Finally, the time filtering unit 47 described in the foregoing exemplary embodiments of the invention corresponds to a filtering section recited in the appended claims.

The entire disclosure of Japanese Patent Application No. 2007-048597, filed Feb. 28, 2007 is expressly incorporated by reference herein.

What is claimed is:

1. An image display apparatus comprising:

a processor;

a display device operatively coupled to the processor;

a frame memory; and a memory device storing instructions which when executed by the processor, cause the processor, in cooperation with the display device and the memory device, to:

(a) cause the frame memory to store inputted image data which includes frame images which include pixels having gradation values, the frame images including a first frame image;

(b) calculate a statistical computation result by performing statistical computation on a gradation value of each pixel based on the image data for each frame image;

(c) using the calculated statistical computation result, correct the image data stored in the frame memory on a frame-by-frame basis;

(d) using the corrected image data:

(i) perform image display;

(ii) calculate a control amount applied to an amount of light emitted from a light source;

(e) using the calculated control amount, control the amount of light emitted from the light source;

(f) determine whether the first frame image constitutes a still picture or not; and (g) in response to the determination being that the first frame image constitutes the still picture, suspend the statistical computation until the first frame image is updated.

2. The image display apparatus of claim 1, wherein the instructions, when executed by the processor, cause the processor to:

(a) in response to the determination being that the first frame image constitutes the still picture, perform statistical computation on the first frame image that constitutes the still picture;

(b) after storing the statistical computation result, suspend the statistical computation; and (c) using the stored statistical computation result, perform correction on the image data during a period in which the statistical computation is suspended.

3. The image display apparatus of claim 1, wherein the instructions, when executed by the processor, cause the processor to:

(a) using the statistical computation result, perform correction on the image data stored in the frame memory;

(b) thereafter, store the corrected image data into the frame memory;

(c) using the corrected image data that is stored tin the frame memory, perform image display; and (d) in response to the determination being that the first frame image constitutes the still picture, suspend the correction until the first frame image is updated.

4. The image display apparatus of claim 1, wherein the instructions, when executed by the processor, cause the processor to:

(a) perform low-pass filter processing on at least one of the corrected image data and the control amount applied to the amount of light emitted from the light source; and (b) in response to the determination being that the first frame image constitutes the still picture, suspend the filter processing until the first frame image is updated.

5. The image display apparatus of claim 1, wherein the instructions, when executed by the processor, cause the processor to determine whether the first frame image constitutes a still picture or not based on still picture information indicating that the frame image constitutes a still picture to the image data of the frame image that corresponds to the still picture, the still picture information being supplied by an image supplying apparatus that supplies the image data.

6. An electronic apparatus comprising:

a processor;

a display device operatively coupled to the processor;

a frame memory; and a memory device storing instructions which when executed by the processor, cause the processor, in cooperation with the display device and the memory device, to:

(a) cause the frame memory to store inputted image data which includes frame images which include pixels having gradation values, the frame images including a first frame image;

(b) calculate a statistical computation result by performing statistical computation on a gradation value of each pixel based on the image data for each frame image;

(c) using the calculated statistical computation result, correct the image data stored in the frame memory on a frame-by-frame basis;

(d) using the corrected image data:

(i) perform image display;

(ii) calculate a control amount applied to an amount of light emitted from a light source;

(e) using the control amount, control the amount of light emitted from the light source;

(f) determine whether the first frame image constitutes a still picture or not; and (g) in response to the determination being that the first frame image constitutes the still picture, suspend the statistical computation until the first frame image is updated.

* * * * *